US008960304B2

(12) United States Patent
Luppi

(10) Patent No.: US 8,960,304 B2
(45) Date of Patent: Feb. 24, 2015

(54) UNDERWATER HYDROCARBON TRANSPORT APPARATUS

(75) Inventor: Ange Luppi, Nîmes (FR)

(73) Assignee: Technip France (FR)

( * ) Notice: Subject to any disclaimer, the term of this patent is extended or adjusted under 35 U.S.C. 154(b) by 53 days.

(21) Appl. No.: 12/999,079

(22) PCT Filed: Jun. 16, 2009

(86) PCT No.: PCT/FR2009/000717

§ 371 (c)(1),
(2), (4) Date: Jan. 10, 2011

(87) PCT Pub. No.: WO2010/007225

PCT Pub. Date: Jan. 21, 2010

(65) Prior Publication Data

US 2011/0100636 A1 May 5, 2011

(30) Foreign Application Priority Data

Jun. 23, 2008 (FR) ..... 08 03498

(51) Int. Cl.
*E21B 7/12* (2006.01)
*E21B 17/01* (2006.01)

(52) U.S. Cl.
CPC ..... *E21B 17/015* (2013.01); *E21B 17/012* (2013.01)
USPC ..... 166/350; 166/355; 166/367; 166/345

(58) Field of Classification Search
USPC ..... 166/350–355, 367, 345; 405/166, 405/169–171, 211, 216
See application file for complete search history.

(56) References Cited

U.S. PATENT DOCUMENTS

| | | | | |
|---|---|---|---|---|
| 4,031,919 | A * | 6/1977 | Ortloff et al. | 137/799 |
| 4,264,234 | A | 4/1981 | Pras | |
| 4,906,137 | A * | 3/1990 | Maloberti et al. | 405/224.3 |
| 5,437,518 | A * | 8/1995 | Maloberti et al. | 405/169 |
| 5,944,448 | A * | 8/1999 | Williams | 405/169 |
| 6,030,145 | A * | 2/2000 | Stewart et al. | 405/172 |
| 6,321,844 | B1 * | 11/2001 | Thiebaud et al. | 166/345 |
| 6,517,290 | B1 * | 2/2003 | Poldervaart | 405/224.2 |
| 6,742,594 | B2 * | 6/2004 | Langford et al. | 166/350 |
| 6,834,724 | B2 * | 12/2004 | Headworth | 166/384 |

(Continued)

FOREIGN PATENT DOCUMENTS

| | | | |
|---|---|---|---|
| FR | 2424464 | A | 11/1979 |
| WO | WO 2008/056185 | A | 5/2008 |

OTHER PUBLICATIONS

International Search Report dated Nov. 25, 2009, issued in corresponding international application No. PCT/FR2009/000717.

*Primary Examiner* — Matthew Buck
*Assistant Examiner* — Aaron Lembo
(74) *Attorney, Agent, or Firm* — Ostrolenk Faber LLP

(57) ABSTRACT

An underwater fluid transport apparatus (10) to transport a fluid between a sea bed (12) and the surface (14) of the sea vertically above the sea bed. A riser (20) is connected to a flexible pipe (32) leading to the sea surface (14). A retaining float (24) is installed around the riser in order to maintain the riser (20) in a stretched suspended position between the sea bed (12) and a subsurface region situated between the sea bed and the surface (14) of the sea. The flexible pipe (32) extends in a catenary curve between the riser (20) and the sea surface. An additional float (28) is installed between the riser (20) and the sea surface (14). The riser (20) is attached to the additional float (28) to increase the buoyancy of the riser.

14 Claims, 4 Drawing Sheets

(56) References Cited

U.S. PATENT DOCUMENTS

| | | | | |
|---|---|---|---|---|
| 6,854,930 | B2 * | 2/2005 | Pionetti | 405/172 |
| 7,025,533 | B1 * | 4/2006 | Mungall et al. | 405/158 |
| 7,073,593 | B2 * | 7/2006 | Hatton et al. | 166/367 |
| 7,434,624 | B2 * | 10/2008 | Wilson | 166/368 |
| 2004/0028477 | A1 * | 2/2004 | Kelm et al. | 405/203 |
| 2004/0129425 | A1 * | 7/2004 | Wilson | 166/359 |
| 2006/0067792 | A1 * | 3/2006 | Joshi et al. | 405/171 |
| 2007/0044972 | A1 | 3/2007 | Roveri et al. | |
| 2007/0081862 | A1 * | 4/2007 | Wolbers et al. | 405/169 |
| 2008/0196899 | A1 * | 8/2008 | Alliot | 166/350 |
| 2009/0269141 | A1 * | 10/2009 | Li et al. | 405/169 |
| 2010/0018717 | A1 * | 1/2010 | Espinasse et al. | 166/346 |
| 2010/0166500 | A1 * | 7/2010 | Roveri et al. | 405/169 |
| 2011/0188942 | A1 * | 8/2011 | Millheim | 405/166 |
| 2011/0286802 | A1 * | 11/2011 | Persson et al. | 405/170 |

* cited by examiner

UNDERWATER HYDROCARBON TRANSPORT APPARATUS

CROSS-REFERENCE TO RELATED APPLICATIONS

The present application is a 35 U.S.C. §371 national phase conversion of PCT/FR2009/000717, filed Jun. 16, 2009, which claims priority of French Application No. 0803498, filed Jun. 23, 2008, the contents of which are incorporated by reference herein. The PCT International Application was published in the English language

BACKGROUND OF THE INVENTION

The present invention relates to an underwater fluid transport installation for transporting hydrocarbons for example, and to a method for positioning such an installation between a sea bed and a sea surface situated vertically above the sea bed.

Known installations make it possible to extract the hydrocarbons from underwater deposits. In addition to the difficulties associated with the pressure exerted by the marine environment on these installations, which increases as the depth of extraction increases, other difficulties result from the difference of the disturbances between the sea surface and the sea bed. Specifically, at the sea surface, the water is relatively turbulent to a variable depth of approximately thirty meters beneath the surface, while on the sea bed, it is much less turbulent because it does not sustain the influence of the wind and of the swell in particular. Therefore, such phenomena make it necessary to adapt the installations for extracting the hydrocarbons and for transporting them without disruption from the sea bed to the surface. Therefore, the installations comprise a riser, usually rigid, which extends between the sea bed and a subsurface zone situated beneath the sea surface, and more particularly beneath the aforementioned turbulent zone. This riser is fitted with one or more retaining floats which are installed around it, up to its end in order to keep it stretched in suspension vertically between the sea bed and the subsurface zone. Usually, these retaining floats are cylindrically symmetrical, and the riser passes through them axially. Therefore, the riser is held vertically in a relatively calm zone and its top end is then connected to a flexible duct which leads to a surface vessel floating on the sea surface. In this way, the flexible duct sustains the surface turbulence by deforming without being damaged.

Document US 200700 44 972 describes a system of the hybrid tower type in which one or more floats are mounted around the riser. These retaining floats are symmetrically cylindrical and the riser passes through them axially. However, this configuration is not satisfactory because considerable forces are exerted at the interface between the buoys and the riser, thus weakening the underwater installation.

Many hydrocarbon deposits are situated underground beneath sea beds that are relatively deep, for example more than 1500 meters, and the risers are consequently of increasing length. Therefore, they are increasingly heavy and the floats necessary to hold them in position vertically must be increasingly voluminous in order to increase their buoyancy. Therefore, bringing such floats in line with the hydrocarbon deposits is relatively difficult and requires a large amount of energy since they have to be towed.

Therefore, one problem that arises and that the present invention aims to solve is to propose an installation for the underwater transport of fluids, and precisely of hydrocarbons, which not only makes it possible to extract the hydrocarbons from relatively deep deposits but also which can easily be applied at an advantageous cost and has an acceptable behavior in terms of ageing and fatigue under the effect of the currents and the movements of swells.

SUMMARY OF THE INVENTION

For the purpose of solving this problem, the present invention proposes a fluid transport installation for transporting a fluid between a sea bed and a sea surface vertically above said sea bed, said fluid transport installation comprising a riser connected to a flexible duct, and a retaining float installed around said riser to keep said riser stretched in suspension between said sea bed and a subsurface zone situated between said sea bed and said sea surface, while said flexible duct extends like a catenary between said riser and said sea surface; according to the invention, the installation also comprises an additional float installed between said riser and said sea surface; and said riser is coupled to said additional float to increase the buoyancy of said riser.

Therefore, a particularly advantageous feature of the invention lies in the use of both a retaining float which surrounds the riser and an additional float to which it is coupled. This increases the buoyancy of the riser which makes it possible to suspend increasingly heavy risers for increasingly deep seas. Furthermore, to a certain degree, the use of two floats, one directly secured to the riser, the other vertically above this riser, makes it possible to provide floats of smaller dimensions than a single float although the total volume of the two floats is greater than the volume of a single float used according to the prior art to suspend heavy ducts.

Moreover, said riser and said flexible duct are connected together by means of a gooseneck duct installed between said floats so as to be able to stretch the flexible duct as a catenary between the riser and a surface vessel floating on the sea surface. This specific configuration allows the installation according to the invention to provide great resistance to ageing due to the movements of swell and to the currents.

Advantageously, said riser and said additional float are coupled together by means of a post and, preferably, the gooseneck duct is installed and held inside said post. As will be explained below, the post has a foot to which the riser is connected and a head connected to the additional float. The gooseneck duct is secured to the foot of the post and extends to the head.

Advantageously, said retaining float is symmetrically cylindrical and said riser extends axially inside said retaining float. Moreover, and according to a preferred feature, said riser has a top end furnished with a collar forming a shoulder, while said retaining float has a bearing edge capable of receiving said collar resting on it in order to support said riser. In this way, the riser extends longitudinally inside the retaining float and the latter, oriented vertically, tends to be drawn to the sea surface and consequently to retain the riser which is trapped in the retaining buoy by means of its collar which for its part rests against the bearing edge.

Moreover, and according to a particularly advantageous embodiment of the invention, the installation comprises an elastically deformable spacer installed coaxially between said retaining float and said riser, which is free to move inside the retaining float according to a restricted amplitude of movement. In this way, the bending moments between the retaining float and the riser are attenuated.

Moreover, said floats advantageously have a diameter of less than 5 meters which makes it possible to transport these floats directly on the positioning vessels and to install them through the latter. Preferably the floats also have a total volume of more than 800 $m^3$ and can then support risers of more than 800 tons.

Advantageously, according to a particular embodiment of the invention, these floats consist of a plurality of caissons that are independent of one another so as to maintain the overall properties of the float when only one of the caissons is damaged and water enters it.

According to another aspect, the present invention proposes a method for positioning an underwater fluid transport installation as described above, said method being of the type in which a positioning vessel is provided having a central positioning well surmounted by a positioning tower, according to the invention, said method comprises the following steps in order: a) a tubular duct having a top retaining end is provided on said positioning vessel; b) said tubular duct is then submerged to form a riser and said top retaining end is held on said positioning vessel; then c) a retaining float is installed around said top retaining end in order d) to submerge said top retaining end surrounded by said retaining float through said central well; then e) an additional float is coupled to said top retaining end surrounded by said retaining float; and, finally, f) said additional float is submerged through said central well.

Therefore, the floats are no longer installed with a derrick as is the case according to the prior art, but through the central well of the positioning vessel which makes installation easier and less costly.

Advantageously, in steps a) and b), a plurality of duct sections are provided and said duct sections are connected successively while simultaneously submerging said duct sections connected section-by-section to form said tubular duct, so as to form a riser. Moreover, a gooseneck duct is preferably connected to said top retaining end between step d) and step e). Preferably, the gooseneck duct is installed inside a post which is also submerged through the central well and to which the additional float is directly connected as will be explained in greater detail below.

Other particular features and advantages of the invention will emerge on reading the description made below of a particular embodiment of the invention, given as an indication but not being limiting, with reference to the appended drawings in which:

DESCRIPTION OF PREFERRED EMBODIMENTS

Figure 1:
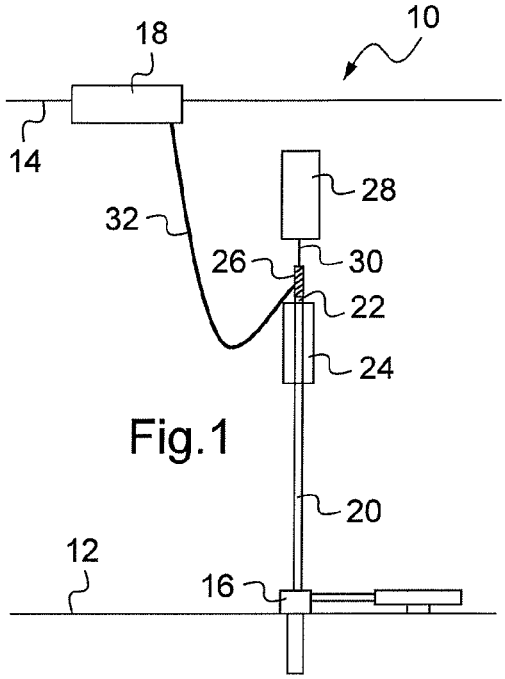
FIG. 1 is a schematic view of the installation according to the invention.

FIG. 1 shows schematically an installation for the underwater transport of hydrocarbons 10 between a sea bed 12 and a sea surface 14. It will be observed that the hydrocarbons thus extracted usually also contain water and various gases. On the sea bed 12 a foundation is installed furnished with means 16 for anchoring the riser which is connected to an underground deposit and, on the sea surface 14, floats a surface installation 18 inside which a hydrocarbon is capable of being collected. The installation 10 comprises a rigid riser 20 which extends from the sea bottom 12 to a top end 22. This rigid riser 20 is fitted with a retaining float 24 to which it is secured at the top end 22. The installation 10 also comprises connection means 26 that will be explained in detail below with reference to FIG. 2, and an additional float 28 connected to the connection means 26 via a flexible link 30. Moreover, the connection means 26 and the surface installation 18 are connected together by means of a flexible duct 32 which extends as a catenary and which makes it possible to connect in a sealed manner the rigid riser 20 and the surface vessel 18 for conveying the hydrocarbon.

Figure 2:
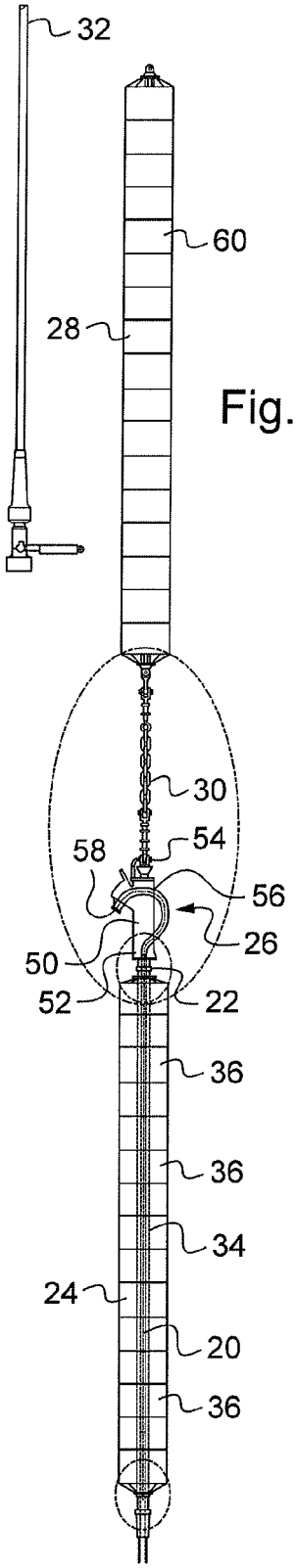
FIG. 2 is a detailed schematic view of a part of the installation illustrated in FIG. 1.

The arrangement of the two floats 24, 28 will be examined below in greater detail with reference to FIG. 2. First of all, the retaining float 24 which is symmetrically cylindrical has at its center 34 a longitudinal passageway inside which the riser 20 extends. The retaining float 24 consists of a plurality of caissons that are independent and sealed from one another. FIG. 2 shows, as an example, 15 caissons 36 which are 2.5 meters high, or a total height of 37.5 meters. Moreover, these caissons have a diameter of approximately 3.7 meters. Consequently, the total volume of the retaining float is approximately 400 $m^3$, which corresponds to a suspension capability of 400 tons deducted from the total weight of the retaining float 24.

Before describing in detail the other elements shown in this figure, a description will first be given, with reference to FIG. 3, of the method for attaching the retaining float 24 and the riser 20 and then, with reference to FIG. 4, of a method of damping their relative movements.

Figure 3:
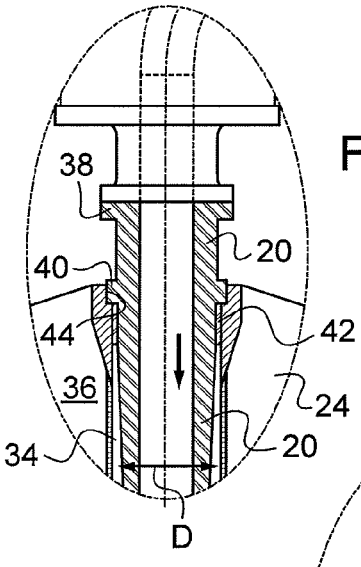
FIG. 3 is a detailed schematic view of a portion of said part illustrated in FIG. 2.

Therefore FIG. 3 shows the top end 22 of the riser 20. This top end 22 has a connection flange 38 and, set back, a locking collar 40. This locking collar 40 forms a shoulder 42 oriented toward the sea bottom 12. Furthermore, the retaining float 24 has, at the first caisson 36, a circular bearing edge 44 against which the shoulder 42 of the locking collar 40 rests. Therefore, the riser 20, which is drawn toward the sea bed 12 under the effect of its own weight, is capable of being retained by means of the retaining float 24 at its locking collar 40.

Moreover, it will be observed that the passageway at the center 34 of the retaining float 24 has a diameter substantially greater than that of the rigid duct D which, for its part, is for example of the order of 40 cm. Therefore, the rigid duct 20 has a range of movement inside the retaining float 24, quite clearly according to relatively small amplitudes.

Figure 4:
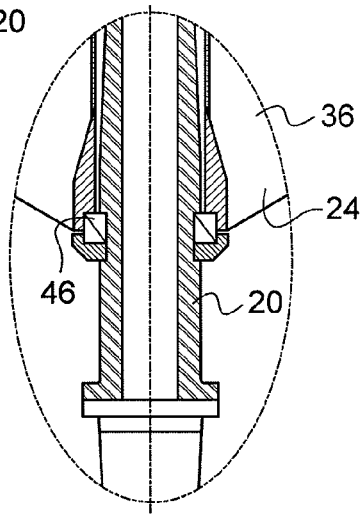
FIG. 4 is a detailed schematic view of another portion of said part illustrated in FIG. 2.

At the bottom end of the retaining float 24 shown in FIG. 4, an elastically deformable spacer 46, or flexible seal, is mounted around the rigid duct and concentrically inside the retaining float at the last caisson. In this manner, the possible movements of the riser 20 relative to the retaining float 24 are damped by means of this spacer 46. Consequently, the bending moments between the retaining float 24 and the riser 20 are attenuated at this level by the deformation of the spacer 46.

Reference will again be made to FIG. 2 which shows, in addition to the elements already described above, the connection means 26 suspended from the additional float 28 by means of the flexible link 30. These connection means 26 comprise a post 50 having a foot 52 to which the top end 22 of the riser 20 is attached, and a head 54 secured to the flexible link 30. Moreover, a gooseneck duct 56 extends inside the post 50, from the foot 52 to the head 54. This gooseneck duct 56 has a free end 58 to which the illustrated flexible duct 32 can be connected. The gooseneck duct 56 is quite clearly connected in a sealed manner to the riser 20.

Moreover, and it is an advantageous feature of the invention, the post 50 is coupled to the additional float 28 by means of the flexible link 30 comprising a chain so as to further increase the buoyancy of the riser 20. Moreover, the additional float 28 has dimensions comparable to those of the retaining float 24, and notably in terms of diameter, which has a considerable advantage for the installation as will be explained below.

In the example shown in FIG. 2, the additional float 28 no longer comprises 15 caissons, but 17 caissons 60 each 2.5 meters high, identical to the caissons 36 of the retaining float 24. Consequently, the lift force procured by this additional float 28 is substantially 50 tons more than those of the retaining float 24.

In this manner, the retaining float 24 and the additional float 28, in this instance shown as an example, make it possible to exert a lift tension on the riser 20 of the order of 850 tons deducted from the weight of these floats, which makes it possible to hold in vertical position risers of a greater length and of a greater weight than those of the prior art for applications at shallower depth. Moreover, because of their small diameter, these floats have advantages in terms of use of the installation as will be explained below with reference to FIGS. 5A to 5C illustrating a possible method of installing the underwater installation according to the invention.

Usually, said positioning vessel is supplied with a tubular duct having a top retaining end and said tubular duct is submerged to form a riser while keeping said top retaining end 22 on said positioning vessel. Then, while the top end 22 is held, the retaining float is installed around the top retaining end 22, then the top retaining end surrounded by the retaining float is submerged through said central well. An additional float is then attached to said top retaining end surrounded by said retaining float. Finally, said additional float is submerged through said central well.

Figure 5A:
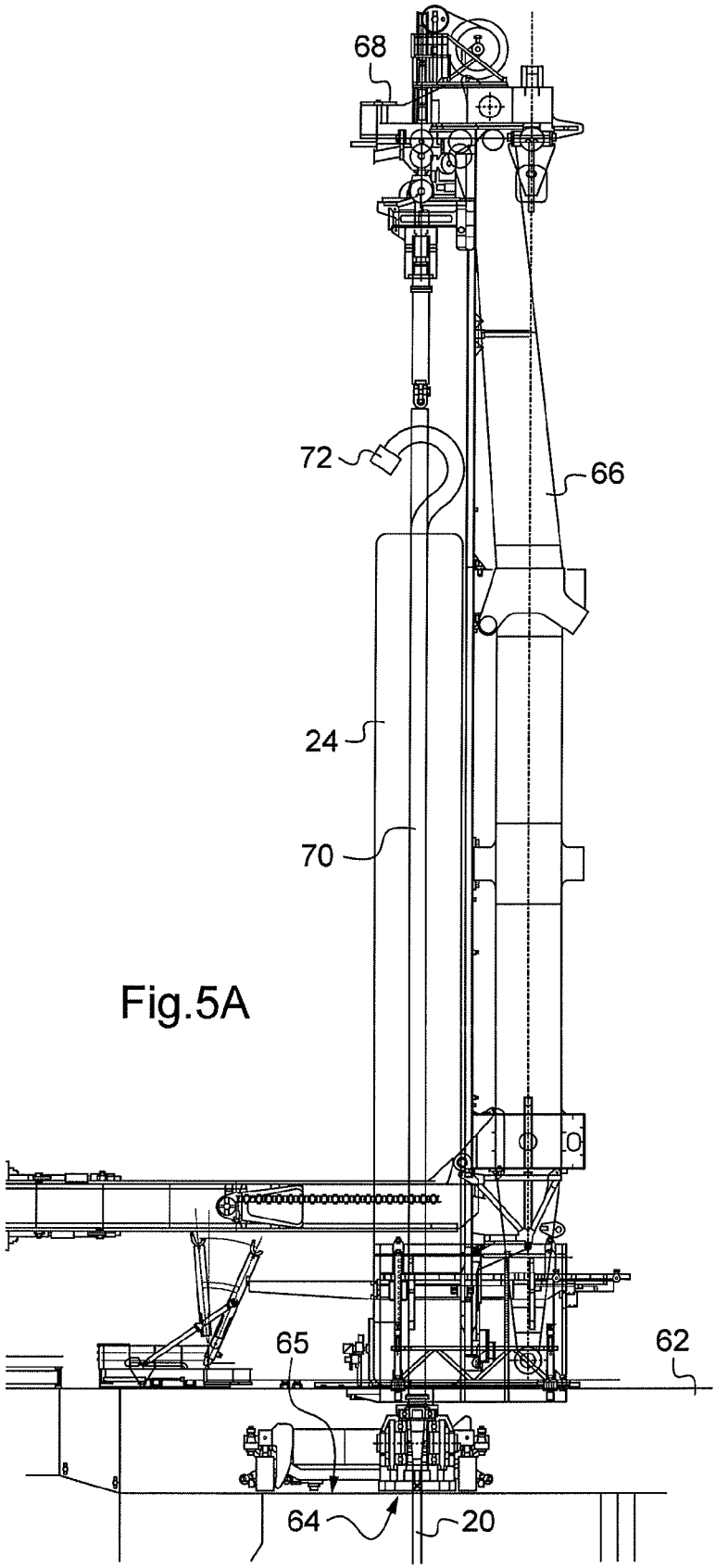
FIGS. 5A to 5C are schematic views illustrating a method for positioning the installation according to the invention.
Figure 5B:
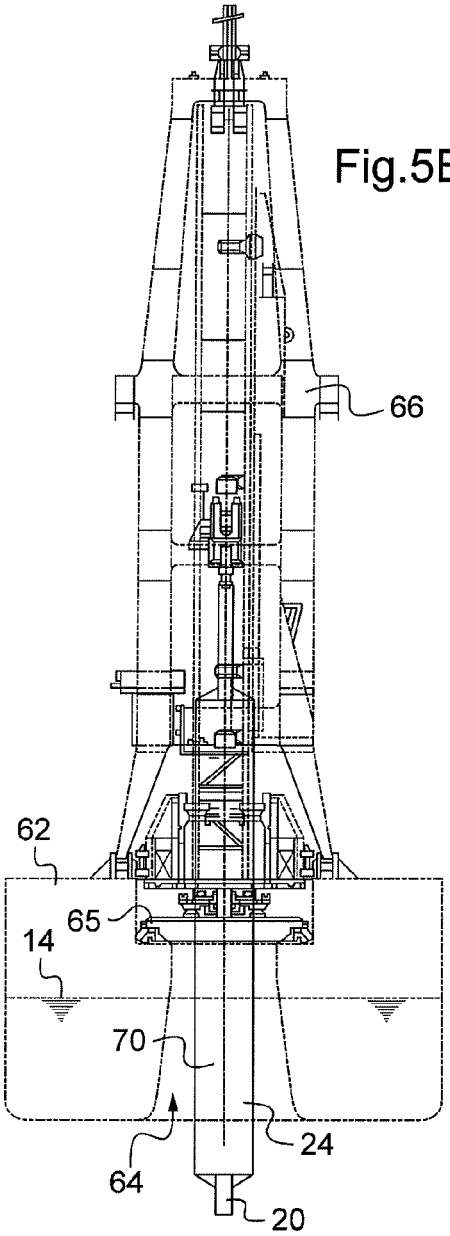
Figure 5C:
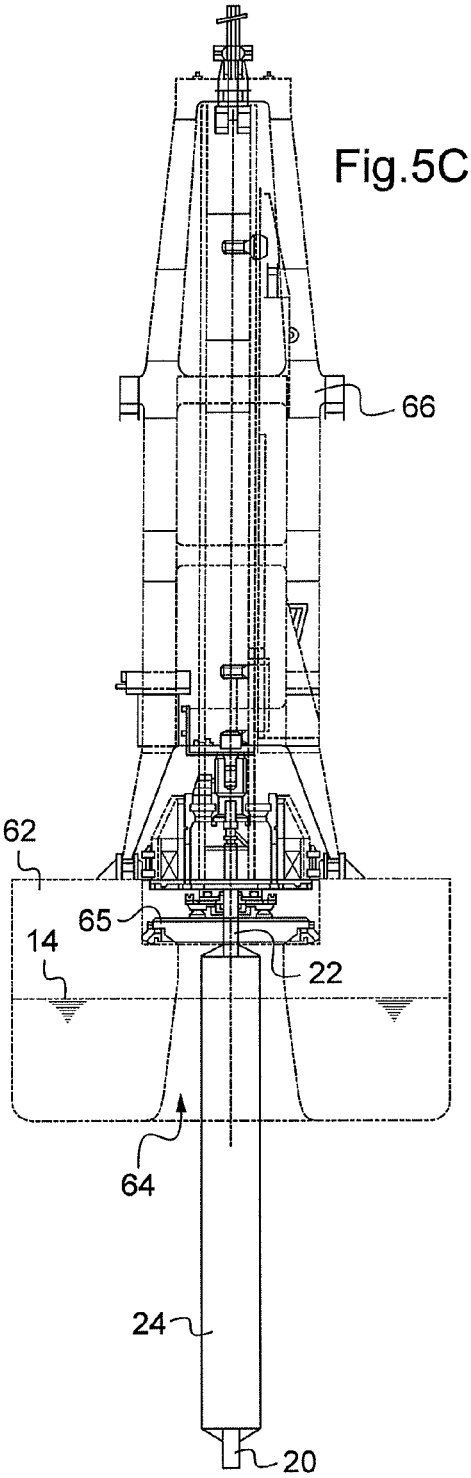
Figure 5D:
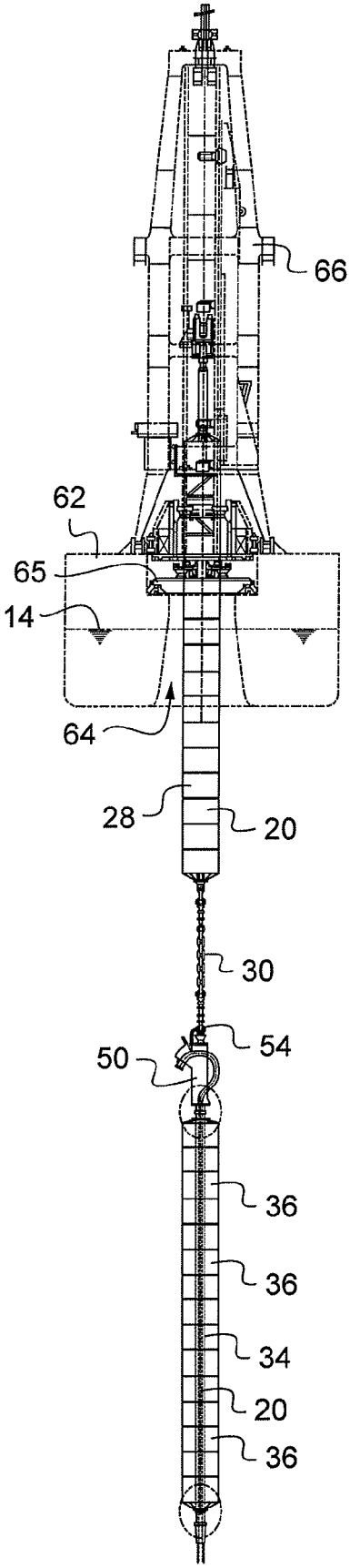

Partially shown in FIG. 5A is a positioning vessel 62 in longitudinal section, which shows a central positioning well 64 bordered by a work table 65 and a positioning tower 66 terminated by an installation post which extends vertically above the central positioning well 64.

First, the positioning vessel 62 is loaded with riser elements, not shown, designed to be welded together to form riser sections, themselves welded together to form finally the riser. The rigid riser is thus positioned according to a method called "J-Lay". Therefore, according to this method, the duct elements and the duct sections are assembled to form a single continuous riser which is submerged step by step, gradually as the sections are assembled, through the central positioning well 64 while retaining the last section by means of a retaining sling from the installation post 68. When a last section 70 of riser is extended vertically along the positioning tower 66 and assembled to the penultimate section which for its part is already at least partially submerged, it is fitted on the one hand with the retaining float 24 that is shown here around this last section 70 of riser and, on the other hand, with a gooseneck duct 72. This retaining float 34, in this instance shown in a single piece, has a diameter of less than four meters for example, and can consequently pass through the central positioning well 64 which has a larger diameter, for example of the order of five meters. Then, by virtue of the positioning tower 66, the riser fitted with its retaining float 24 is submerged in its turn and is drawn in translation through the central positioning well 64. FIG. 5B shows in cross section the positioning vessel 62 and the positioning tower 66 which submerges the last section 70 of riser surrounded by its retaining float 24. After the last section 70 of riser has been submerged with the retaining float 24, the top end of the riser 22 remaining at the work table 65 as illustrated in FIG. 5, this top end 22 is then fitted with the post 50 not shown here and the additional float 28, also not shown, is installed and held vertically on the positioning tower 66. It is then connected to the post 50 and then the assembly is submerged through the central positioning well 64 just like the retaining float 24. The additional float is then held by the positioning tower 66 by means of the sling, so as to be able to adjust the riser to the desired position between the sea surface and the sea bed 12.

Therefore, by virtue of the geometry of the floats, that is to say a great length relative to a small diameter, and also their assembly, one being a retaining float 24 around the riser 20, the other 28 being located vertically above the riser and coupled by means of the post 50, the assembly is capable of being submerged through the central positioning well 64 of the positioning vessel 62 without requiring an additional derrick for the installation.

Moreover, it will be observed in FIG. 2 that the flexible link 30, in this instance consisting of a chain, is extended at each of its ends by a metal rod; one top rod connecting the chain and the additional float 28, the other a bottom rod, connecting the chain and the head 54 of the post 50. The bottom metal rod makes it possible to retain the catenary consisting of the riser during installation, at the work table 65 by means of a clamping tool making it possible to clamp said bottom metal rod and to temporarily hold the duct in fixed position relative to the positioning vessel 62 during installation of the float.

In the same manner, provision is made to temporarily weld the top metal rod to the top end of the additional float 28 so as to be able to retain the assembly.

Clearly, such a positioning method could very well be applied according to the techniques called "rigid roll-out". In this case the rigid duct is previously rolled up in a single piece on a suitable drum and it is paid out through the central well to form the riser.

What is claimed is:

1. An underwater fluid transport installation for transporting vertically a fluid between a sea bed and a sea surface above the sea bed, the fluid transport installation comprising:

a riser having a top retaining end, the riser configured to extend to the sea bed and connected to a flexible duct to extend toward the sea surface, a retaining float in a single piece installed around the riser, the retaining float secured at the top retaining end of the riser and configured to keep the riser stretched in suspension between the sea bed and a subsurface zone situated between the sea bed and the sea surface, while the flexible duct extends in a catenary between the riser and the sea surface; and an additional float installed between the top retaining end of the riser and the sea surface;

wherein the riser is coupled to the additional float to increase the buoyancy of the riser, the retaining float and the additional float each have a diameter less than 5 meters and the floats have a combined volume of at least 800 $m^3$, wherein the retaining float includes a bearing edge, and the top retaining end of the riser includes a collar forming a shoulder configured to rest on the bearing edge.

2. The fluid transport installation as claimed in claim 1, wherein the riser and the flexible duct are connected together by a gooseneck duct between the retaining float and the additional float.

3. The fluid transport installation as claimed in claim 2, further comprising a post coupling together the riser and the additional float.

4. The fluid transport installation as claimed in claim 1, wherein the retaining float is symmetrically cylindrical and the riser extends axially inside the retaining float.

5. The fluid transport installation as claimed in claim 4, wherein the bearing edge is configured to receive the collar.

6. The fluid transport installation as claimed in claim 4, further comprising an elastically deformable spacer installed coaxially between the retaining float and the riser.

7. The fluid transport installation as claimed in claim 4, wherein the retaining float and the additional float have a diameter of less than 5 meters.

8. The fluid transport installation as claimed in claim 1, wherein the retaining float and the additional float each comprise a plurality of caissons, each caisson being independent of and sealed off from other caissons of the plurality of caissons.

9. A method for positioning the underwater fluid transport installation as claimed in claim 1, the method comprising the following steps in order:

forming the riser by submerging a tubular duct having the top retaining end the submerging performed by a positioning vessel with a central positioning well surmounted by a positioning tower;

holding the top retaining end on the positioning vessel;

installing the retaining float around the top retaining end;

submerging the top retaining end surrounded by the retaining float through the central well;

coupling an additional float to the top retaining end surrounded by the retaining float and, submerging the additional float through the central well.

10. The positioning method as claimed in claim 9, wherein the forming the riser comprises:

providing a plurality of duct sections; and connecting the duct sections successively while simultaneously submerging the duct sections connected section-by-section to form the tubular duct.

11. The positioning method as claimed in claim 9, further comprising connecting a gooseneck duct to the top retaining end before the coupling of the additional float.

12. The fluid transport installation as claimed in claim 1, further comprising a post coupling together the riser and the additional float.

13. The fluid transport installation as claimed in claim 1, wherein the retaining float includes a passageway positioned along a longitudinal extent of the retaining float and configured to accommodate the riser, the passageway having a diameter substantially greater than a diameter of the riser.

14. The fluid transport installation as claimed in claim 13, further comprising a spacer positioned inside the passageway around the riser, the spacer positioned to dampen movements of the riser relative to the retaining float.

* * * * *